US008875983B2

(12) United States Patent
Lenhard et al.

(10) Patent No.: US 8,875,983 B2
(45) Date of Patent: Nov. 4, 2014

(54) SELF-SEALING BOX FOR TRASH COMPACTORS

(75) Inventors: Gil Lenhard, Torrance, CA (US); Brian Adams, Torrance, CA (US); Jason Gscheidmeier, Hickory, NC (US); Scott Gehl, Appleton, WI (US)

(73) Assignees: MAG Aerospace Industries, LLC, Carson, CA (US); Dura-Fibre, LLC, Menasha, WI (US)

( * ) Notice: Subject to any disclaimer, the term of this patent is extended or adjusted under 35 U.S.C. 154(b) by 61 days.

(21) Appl. No.: 13/555,216

(22) Filed: Jul. 23, 2012

(65) Prior Publication Data

US 2013/0026215 A1 Jan. 31, 2013

Related U.S. Application Data

(60) Provisional application No. 61/512,026, filed on Jul. 27, 2011.

(51) Int. Cl.

| | |
|---|---|
| ***B65D 5/36*** | (2006.01) |
| ***B65D 5/42*** | (2006.01) |
| ***B65D 5/18*** | (2006.01) |
| ***B65D 5/68*** | (2006.01) |

(52) U.S. Cl.

CPC ..... *B65D 5/4266* (2013.01); *B65D 5/18* (2013.01); *B65D 5/685* (2013.01); *Y10S 229/907* (2013.01)

USPC ..... 229/117.05; 229/5.84; 229/193; 229/907

(58) Field of Classification Search

USPC ..... 229/117.05, 117.06, 193, 907, 5.84, 229/931

See application file for complete search history.

(56) References Cited

U.S. PATENT DOCUMENTS

| | | | | |
|---|---|---|---|---|
| 899,212 | A * | 9/1908 | Fiske | 229/193 |
| 1,407,483 | A * | 2/1922 | Rike | 229/193 |
| 1,431,128 | A * | 10/1922 | Sappenfield | 229/193 |
| 2,138,680 | A * | 11/1938 | Siewert | 229/193 |
| 2,152,732 | A * | 4/1939 | Dreymann | 229/5.84 |

(Continued)

FOREIGN PATENT DOCUMENTS

| | | |
|---|---|---|
| WO | 2005058715 A1 | 6/2005 |
| WO | 2013016254 A1 | 1/2013 |

OTHER PUBLICATIONS

International Search Report and Written Opinion dated Oct. 25, 2012 in Application No. PCT/US2012/047785.

(Continued)

*Primary Examiner* — Gary Elkins

(74) *Attorney, Agent, or Firm* — Kilpatrick Townsend and Stockton LLP; Dean W. Russell, Esq.; Kristin M. Crall, Esq.

(57) ABSTRACT

Embodiments of the present invention provide boxes that are particularly useful in connection with trash collection and trash compaction. The boxes are designed as having a single-piece board construction with a strength that can contain mixed types of trash, including solids and liquids, and to effectively contain the trash during the pressure of a compaction process without tearing, splitting and/or leaking. They are also designed to use a waterproof coating for adhering seams, reducing the extra step and expense of using a glue or an adhesive to secure the box seams. The trash compaction boxes provided herein are particularly useful on aircraft and other passenger transport vehicles, where weight and performance are of primary concern.

17 Claims, 4 Drawing Sheets

(56) References Cited

U.S. PATENT DOCUMENTS

| | | | | | |
|---|---|---|---|---|---|
| 2,168,387 | A | | 8/1939 | Bellin | |
| 2,430,755 | A | * | 11/1947 | Bergstein | 229/117.05 |
| 3,434,647 | A | * | 3/1969 | Perkins | 229/117.05 |
| 3,625,410 | A | | 12/1971 | Hirschey | |
| 3,790,066 | A | | 2/1974 | Malinowski | |
| 3,908,888 | A | * | 9/1975 | Gordon | 229/5.84 |
| 4,711,390 | A | | 12/1987 | Andrews et al. | |
| 5,460,324 | A | * | 10/1995 | Vinther | 229/117.05 |
| 5,716,473 | A | * | 2/1998 | Gordon et al. | 229/138 |
| 2011/0253776 | A1 | * | 10/2011 | Craft et al. | 229/117.27 |

OTHER PUBLICATIONS

International Preliminary Report on Patentability dated Feb. 6, 2014 in Application No. PCT/US2012/047785.

* cited by examiner

SELF-SEALING BOX FOR TRASH COMPACTORS

CROSS REFERENCE TO RELATED APPLICATIONS

This application claims the benefit of U.S. Provisional Application Ser. No. 61/512,026, filed Jul. 27, 2011, titled "Self Sealing Paper Box for Trash Compactors," the entire contents of which are hereby incorporated by reference.

FIELD OF THE INVENTION

Embodiments of the present invention relate generally to boxes that are particularly useful in connection with trash collection and trash compaction. The boxes are designed to have a strength that can contain mixed types of trash, including solids and liquids, and to effectively contain the trash during the pressure of a compaction process without tearing, splitting and/or leaking. They are also designed to be lightweight, to use less material than other trash compactor box solutions to date, and to be particularly useful on aircraft and other passenger transport vehicles, where weight and performance are of primary concern.

BACKGROUND

Existing aircraft trash compactor box products provide a lined paperboard box that is assembled from three independent parts using hot melt adhesive. One example is shown in U.S. Pat. No. 4,711,390. The compactor box that is the premium in the marketplace for performance is able to hold water without leaking for many hours and is able to withstand pressures from a trash compactor platen without collapsing. This box, manufactured by Monogram Systems, protects airline and other passenger transport vehicle trash compactors in the field from leakage and best ensures proper trash compactor operation. Competitors have attempted to provide lower price solutions, however these solutions do not meet the functional performance of the premium box. Competitor boxes tend to leak fluids, damaging the trash compactors, and/or causing tearing during compaction, which also leads to leaks or lack of box structural integrity, and can cause jams during compaction due to failure to maintain their proper shape during the cycle.

BRIEF SUMMARY

Embodiments of the invention described herein thus provide an improved trash compactor box. The present inventors have sought to improve upon the Monogram Systems premium box design by maintaining the superior functional aspects of the existing premium box design (leak-proof, structural integrity, collapsible, extreme storage environment resilience), but by providing a single-piece paper board construction design that minimizes material usage, incorporates an alternate fold-score implementation for collapsibility, eliminates the need for hot-melt adhesives, and minimizes the number of processing steps.

DETAILED DESCRIPTION

Embodiments of the invention provide a trash containment box 10 used in trash compactors that will resist leaking and tearing during and after multiple compactions. Furthermore, this box resists tearing and leaking until it reaches its final waste location. The trash compactor box 10 is formed from a single board construction 12. In a specific embodiment, rather than using the 3-piece design of the current premium box, the box 10 is formed from a single piece of flat, die cut polyethylene lined paperboard, referred to as a board construction 12. The board construction 12 incorporates a unique scoring/folding and overall pattern that is intended to minimize material usage while ensuring product structural integrity and positioning for leak-proof seams. Additionally, in place of secondary hot melt glue used in the current premium box, box 10 uses the existing thin, water proof polyethylene coating as the adhesive that holds the blank in the desired box shape and that creates the leak-proof bond on the seams. This is done through heat reactivation during the forming process, reducing fabrication machine complexity and maintenance. It should be understood that although a polyethylene coating is the primary coating intended to be used, it is also possible that other waterproof coatings may be used in connection with this invention or that a combination of a polyethylene and other coatings may be used. In the embodiments where the coating is also used as the adhesive, it is desirable that the coating selected be amendable to re-heating such that it can be used to seal the box seams without the use of a separate glue or hot melt adhesive.

Figure 1:
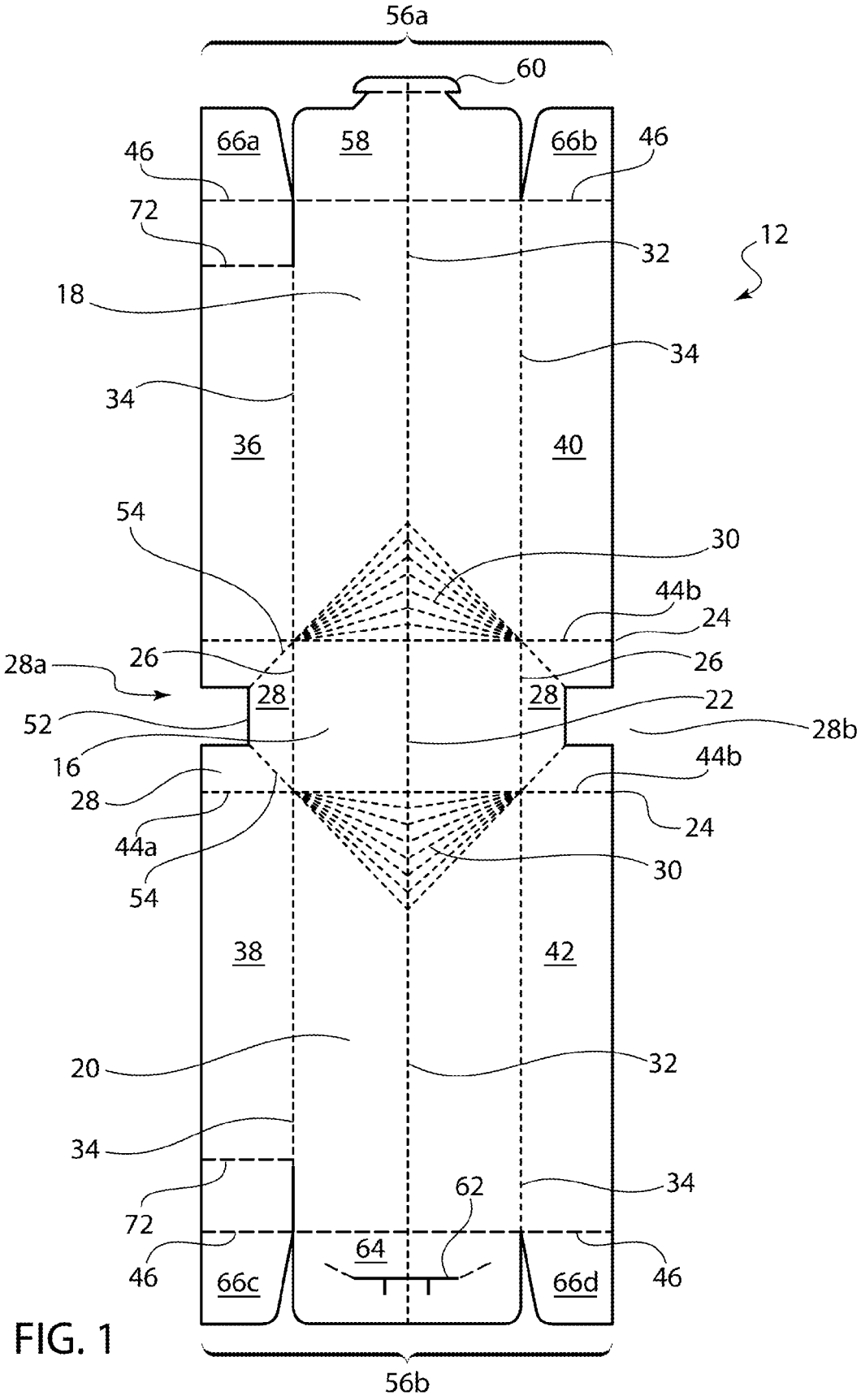
FIG. 1 shows a top plan view of one embodiment of a board construction used to form the trash compactor box described herein.

As shown in FIG. 1, the single-piece board construction 12 has a number of flaps that are separated from one another via fold lines, scores, perforations, or lines of weakness, shown in dotted lines. Generally, these features are provided to ease the folding and collapsing processes, described in more detail below. Scores are akin to lines of weaknesses or areas where the blank has been thinned slightly from pressing or rolling. Scores are shown as short dashed lines in FIG. 1, and are created in the laminated board construction where the material will be folded in the forming process. Scores help prevent the material from cracking and will maintain the continuous uniform coverage of fiber and polyethylene coating necessary to prevent water penetration. Scores are formed as creases or fold lines in the material that allow it to be folded without undue pressure. Perforations are small cuts in the material that also make it easier to fold or bend the material. Similar to scores, perforations are placed in areas where very little force is desired to fold or bend. Once folded, the material has little memory. However, perforations generally will not prevent the passing of water or liquids, so they are preferably used only at portions of the box that are not intended to be water-tight, such as at the top portion of the box. Perforations are shown as long dashed lines in FIG. 1. Although some of the lines may be described as preferably scores and some are preferably perforations, they are all generally provided as lines of weakness or thinner areas of the blank that ease folding and collapsibility. Edge cuts are continuous cuts used within the die cut part, and they define the shape and orientation of the board construction perimeter 12 (shown as continuous lines in FIG. 1).

Board construction 12 is a single-piece blank or board, meaning that it is formed as a one-piece construction having all panels necessary to create a box, without the need for additional panels to be glued thereto. Although the single-piece board construction or blank is referred to as being integral or as a single-piece, it may actually be formed of a laminated material, which is made by combining several plys of paperboard (in some instances, polyethylene coated paperboards) into one "board construction." Additionally, board construction 12 may be formed of fiber board, such as a single stack fiberboard or a multi ply fiberboard, paperboard, corrugated paperboard, or any combinations thereof, or any material suitable to contain and hold trash under compressive pressure.

Figure 4:
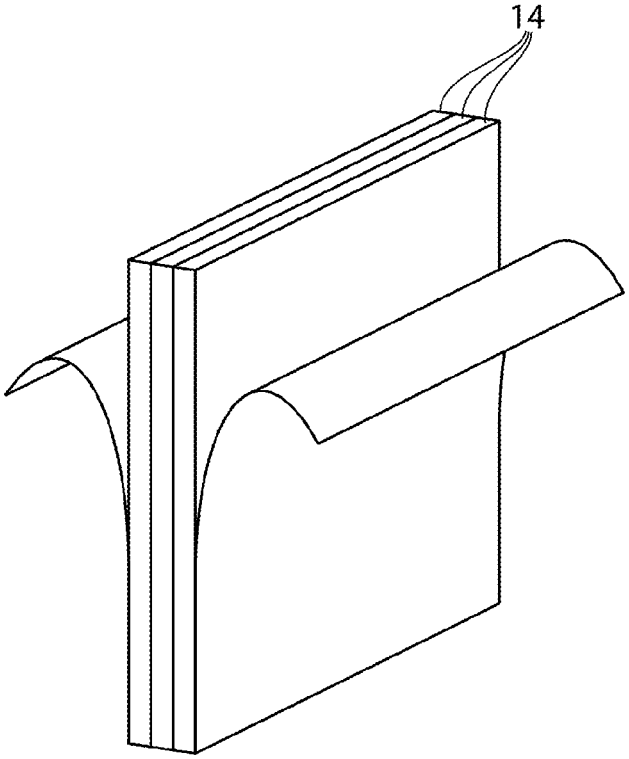
FIG. 4 shows an example of a 3-ply laminated paperboard with a waterproof coating.

As shown in FIG. 4, the first step in manufacturing the trash containment box 10 is the lamination of several layers or plys 14 of paperboard or polyethylene coated paperboard in a solid fiber format that together will give the box the tear, impact, and leak resistance necessary to allow multiple compactions without leaking and tearing both during and after use. This combination of materials is referred to as a single "board construction." While FIG. 4 shows a 3-ply construction, the number of plys used in this board construction may vary and change over time, and other plys are intended to be within the scope of this invention. The plys within this board construction may be held together with any type of appropriate bonding agent, including but not limited to adhesives, polyethylene extrusion, glues, or any other bonding agent used in paper. After this lamination process, the multiple polyethylene coated paperboard material is ready to be die cut into a specified shape.

The board construction 12 is then die cut into the shape shown generally in FIG. 1. This shape readies the board construction 12 for the forming, sealing, collapsing and ultimately, customer use. Within this die cut shape, there are panels and flaps defined by lines of weakness, a term which is intended to encompass scores, perforations, pressed areas, rolled areas, or any area that has been treated or pressed to allow it to fold easier. The board construction also has edge cuts that define the overall external shape. As illustrated in FIG. 1, a bottom panel 16 separates a first side panel 18 and a second side panel 20. The bottom panel 16 has a line of weakness 22 down its center, which is used to assist in folding box 10 into the storage position. Bottom panel 16 also has two interior lines of weakness 24 that separate the bottom panel 16 from the side panels 18, 20. Bottom panel 16 further has two external lines of weakness 26 at each of its edges, each of which is used to allow the cut away portions 28 to be folded up to form a lower front seal and a lower back seal for the box. Finally, bottom panel 16 has pyramid scores or fold creases 30 radiating into each of the side panels 18, 20. Although the radiating creases 30 are shown as having a pyramidal shape, it should be understood that they may be any appropriate shape. Also, although the radiating creases 30 are shown radiating from the bottom panel to the side panels, it is also possible for radiating creases 30 to be positioned on one or more of the end panels (i.e., on one or more of the front and back flaps 36, 38, 40, 42) or to be positioned on portions of the side panels as well as the end panels.

Each of the side panels 18, 20 also has a line of weakness 32 down its center which is used to assist in folding box 10 into the storage position. Side panels 18, 20 meet the bottom panel 16 at lines of weakness 24, which are the fold marks that allow the side panels 18, 20 to fold up from the bottom panel 16. Each side panel 18, 20 further has two external lines of weakness 34 at each of the edges. These fold marks define a first front flap 36, a second front flap 38, a first back flap 40, and a second back flap 42. At the base of each side panel 18, 20 is a cut-away portion fold 44. At the top of each side flap 18, 20 and extending across the front and back flaps 36, 38, 40, 42 is a top portion fold 46. Top portion fold may either be a score line or a perforation, depending upon the required structural rigidity to ensure that the box retains its rectangular shape versus the ease of folding the flap down during the folding/manufacturing process. Near the top portion, the first and second front flaps 36, 38 also have a line of weakness 72, typically provided as a score line as shown in FIG. 1, that creates a front panel fold-down flap 74. When folded down, this flap 74 provides space for loading trash via the small front door of the trash compactor.

Figure 2:
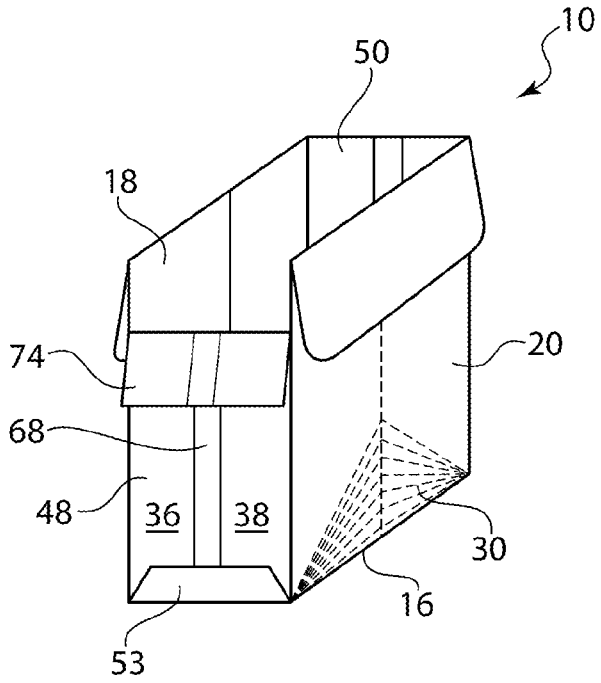
FIG. 2 shows a side perspective view of an assembled box formed from the board construction of FIG. 1
Figure 5:
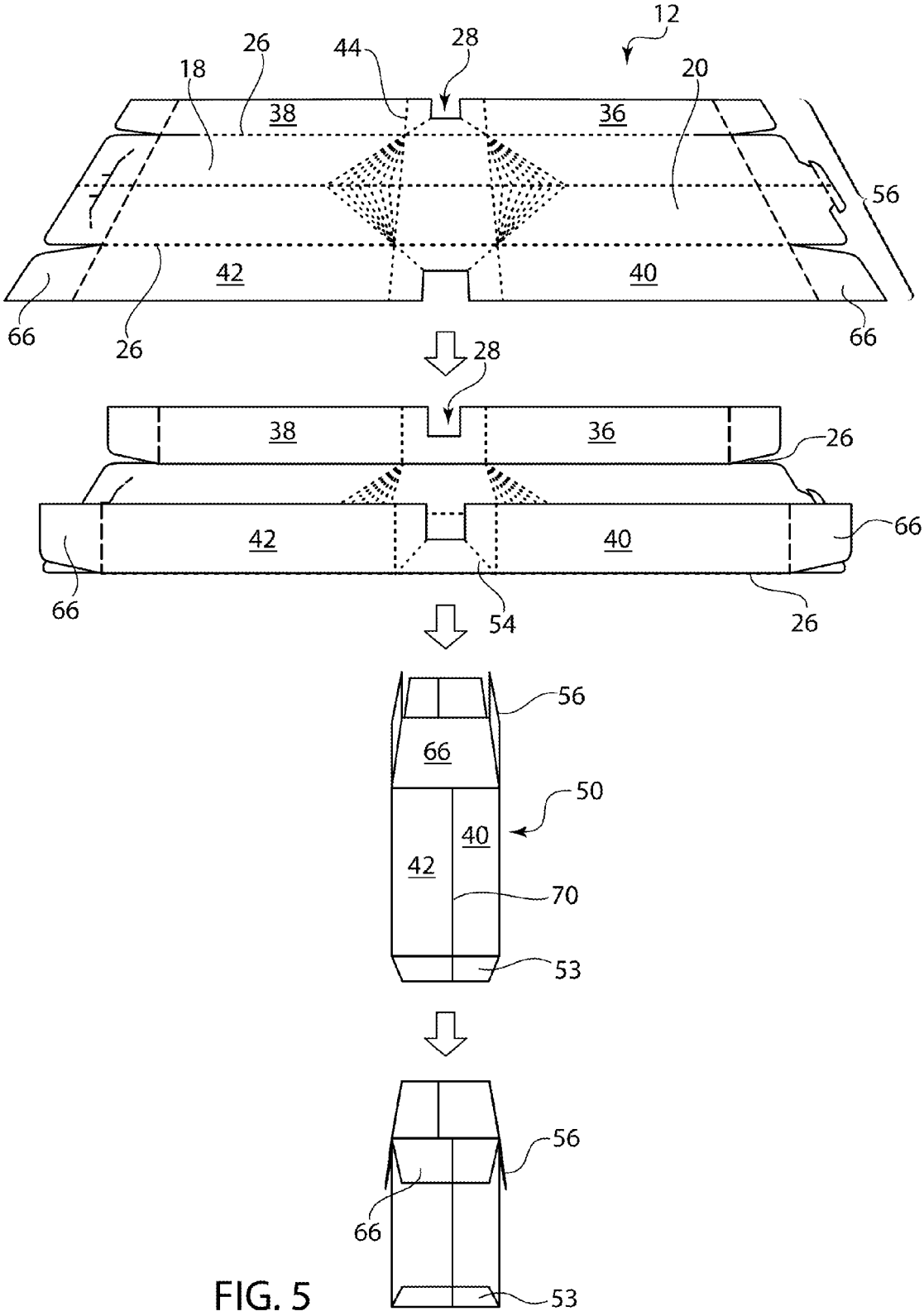
FIG. 5 shows a folding sequence for forming the trash compactor box from the board construction of FIG. 1

Referring now to the two cut-away portions 28, one of the cut away portions 28*a* is positioned between the bases of both of the first front flap 36 and the base of the second front flap 38, such that it separates these two flaps when folded, but such that folding of the cut-away portion allows first and second front flaps 36, 38 to overlap one another in use to create a front panel 48, as shown in FIGS. 2 and 5. The other of the cut away portions 28*b* is positioned between the bases of both of the first back flap 40 and the base of the second back flap 42, such that it separates these two flaps when folded, but such that folding of the cut-away portions allows first and second back flaps 40, 42 to overlap one another in use to form a back panel 50. Cut away portions 28 are shown as having a U-shaped cut-out 52 providing a lip panel 53 defined by two angled lines of weakness 54. Cut away portion 28*a* joins each of the first and second front flaps 36, 38 at cut away portion folds 44*a*, and cut away panel 28*b* joins each of the first and second back flaps 40, 42 at cut away portion folds 44*b*.

A top portion 56 is positioned at the top of each of the side panels 18, 20 and the flaps 36, 38, 40, 42. One of the top portions 56*a* has a middle flap 58 with a tab 60 that is designed to be received by a slot 62 that is positioned on a middle flap 64 of the other top portion 56*b*. The tab and slot features are intended to facilitate closure of the box 10 once compaction has been completed and the trash needs to be contained/covered. Top portions 56 also have side flaps 66*a-d*, which, in connection with middle flaps 58, 64 are used to close the top of the box, much like a cereal box closure configuration. The line of weakness 32 that extends up the middle of the side panels 18, 20 also extends to top portions, which allow top portions to be easily folded with the rest of the board construction 12 for shipping.

Once the board construction 12 has been laminated, polyethylene coated, and die cut/scored/perforated, it is ready to be formed into a usable finished good and ready for use in the trash compactor. The custom folding scores and perforations that are formed into the board construction 12 support automated folding and box reduction during manufacturing, allowing compact delivery, easy end-user expansion, and proper shape retention in the compactor to avoid compactor jamming during operation. It should be understood that although machine folding is the much faster alternative, it is also possible for the board construction 12 to be manually folded. The folding/forming process includes multi-axis movement of each die cut panel sequenced to create the box 10 form illustrated in FIG. 2. As shown, the box 10 has multiple seam lines where panels are joined with other panels or flaps, such that the box holds the shape of the finished box without leaking liquids. As shown in FIG. 5, first and second front flaps 36, 38 and first and second back flaps 40, 42 are folded upwards along the external lines of weakness 26. Cut away portion 28 is then folded by inward creasing along angled lines of weakness 54, which causes the first and second front flaps 36, 38 to overlap one another and create reinforcement of lip panel 53. The same folding is conducted for the back of the box, such that first and second back flaps 40, 42 overlap one another and create a back reinforcement of lip panel 53.

Figure 3:
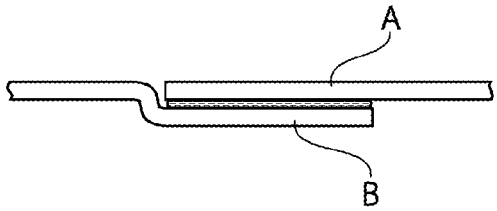
FIG. 3 shows a schematic of the polyethylene coating acting as a seal.

Seam lines are created by overlapping joining flaps 36, 38 and 40, 42. The polyethylene coating on the laminated board construction that is used for water-proofing the box is reheated and used to bond the panels together, as illustrated in FIG. 3. FIG. 3 shows a flap A being secured, sealed, or otherwise adhered to a flap B using a waterproof coating, such as a polyethylene coating therebetween. If a machine is used for the folding process, it is possible for the same machine to have a reheating feature that will heat the polyethylene coating already on the board construction. It has been surprisingly found that the polyethylene coating (used to waterproof the interior panels of the box 10) will also bond panels when heated, by reactivating or melting the material during the forming process such that pressing the two panels together provides a uniform and liquid resistant seal. Heat re-activation of the waterproof polyethylene coating provides a glue-free, leak-proof bond. This eliminates the extra cost and step of using glue or a hot melt adhesive to create the box seams. In some cases, the number of panels being bonded together will vary depending on the exact panels being formed. FIG. 3 illustrates how two panels A, B may be bonded with the reactivated polyethylene coating, without using a separate glue or hot melt adhesive.

The first front flap 36 is sealed to the second front flap 38 to create a front panel 48 having a front seam 68, as shown in FIG. 2. The first back flap 40 is sealed to the second back flap 42 to create a back panel 50 having a back seam 70, as shown in FIG. 5. The last image of FIG. 5 shows a panel lip 53 of a cut away portion 28 folded up and over the lower portion of the back panel 50 and sealed to the back panel 50 by heating the polyethylene coating that is already in place and using the polyethylene coating as an adhesive, which creates a multi-layered, water-tight seal, adhering the lip panel 53 to the front and back panels 48, 50. The top portion 56 flaps and flaps 66 are then folded down.

Because the panels forming the side panels 18, 20 do not have any seams forming these panels, the box 10 is easily positioned in a trash compactor and there are not any side seams to catch or accidentally tear or split during removal of the box 10 from the compactor. Although not shown, it is also possible to provide a leash or integrated handle feature at or near the top of the box, which can assist in carrying the box once it is heavy with compacted trash.

Figure 6:
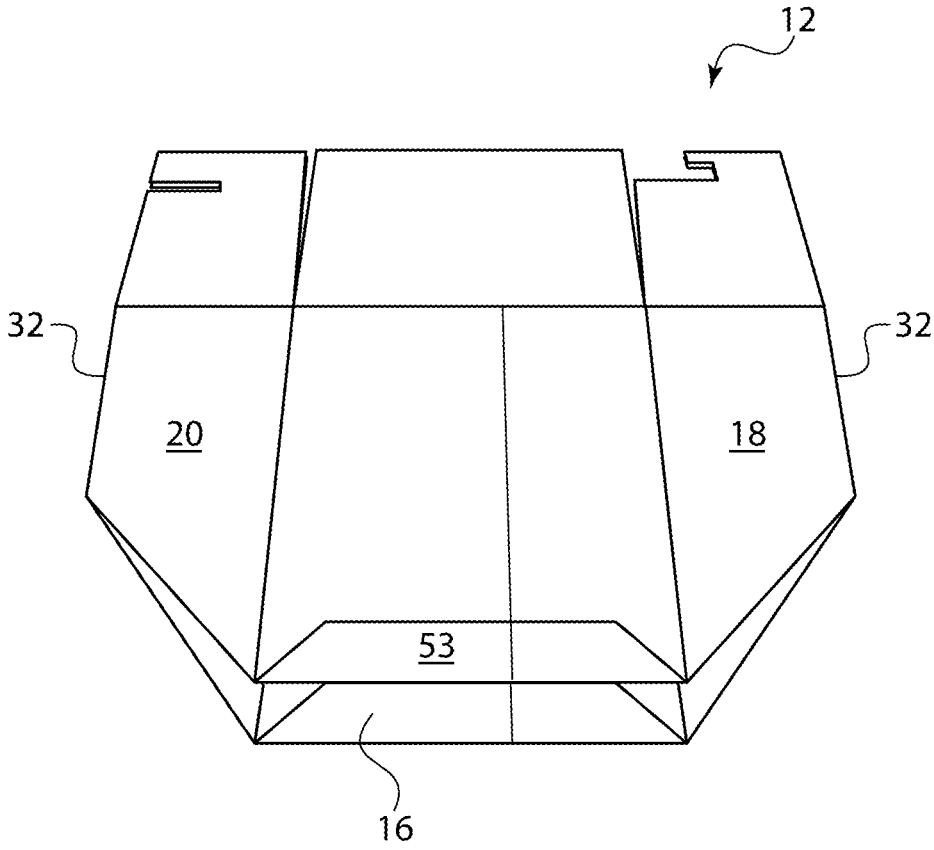
FIG. 6 shows a collapsed box for delivery and storage, prior to use.

Once the box 10 has been folded, formed, and bonded, it is collapsed and placed in a master shipping carton for shipping to the ultimate use destination. An example of a collapsed box is shown in FIG. 6. The lines of weakness 22, 32 that run the height of box are used to assist in this collapse. Additionally, the radiating lines of weakness 30 allow the bottom of the box to be pressed in and inwardly collapsed. This collapse feature will ensure the product can be shipped economically, however, it also ensures the board construction and polyethylene bond remain intact and protect the box from leaking liquid when the customer erects the box for trash compactor use. The collapse feature is provided by the extra scoring placed in the die cutting process. These scores will ensure the box will collapse in the designated area and without much force.

Changes and modifications, additions and deletions may be made to the structures and methods recited above and shown in the drawings without departing from the scope or spirit of the invention and the following claims.

What is claimed is:

1. A box for use in a trash compactor, comprising:

(a) a single-piece construction comprising a bottom panel between first and second side panels, (b) first and second front flaps configured to overlap one another to form a front panel in use, the first and second front flaps extending from first edges of the first and second side panels respectively;

(c) first and second back flaps configured to overlap one another to form a back panel in use, the first and second back flaps extending from second edges of the first and second side panels respectively;

(d) first and second U-shaped cut-away portions extending from front and rear edges of the bottom panel to provide a lip panel; and (e) first and second top portions configured to fold down alongside the first and second side panels in use and to fold over one another in order to close the box for storage after use.

2. The box of claim 1, wherein the single-piece board construction blank is multi-ply laminated paperboard having a water-resistant, water-proof, or water-repellant coating applied to at least a portion of a surface forming an inner portion of the box.

3. The box of claim 2, wherein the coating is a polyethylene coating.

4. The box of claim 1, wherein in the first and second front flaps and the first and second back flaps are adhered to one another via a polyethylene coating.

5. The box of claim 1, further comprising first foldable cut-away portion positioned alongside the bottom panel and between the first and second front flaps, and a second foldable cut-away portion positioned alongside the bottom panel and between the first and second back flaps.

6. The box of claim 5, wherein the first and second foldable cut-away portions create a lower crease and a lip panel at the base of the front and back panels in use.

7. The box of claim 1, wherein the first and second top portions comprise closure elements.

8. The box of claim 7, wherein the closure elements comprise a tab on one of the first or second top portions and a slot on the other of the first or second top portions, such that the tab is received by the slot to close the box.

9. The box of claim 1, further comprising lines of weakness extending along a middle portion of the board construction between the bottom panel, the first and second side panels, and the top portions for ease of collapsibility.

10. The box of claim 1, wherein the single-piece blank comprises scores between the bottom panel, the first and second side panels, and the first and second front and back flaps to ease folding.

11. The box of claim 1, wherein the single-piece blank comprises perforations between the first side panel and the first top portion and between the second side panel and the second top portion to ease folding.

12. The box of claim 1, wherein the side panels comprise radiating lines of weakness to ease folding.

13. The box of claim 1, wherein the box comprises an integrated handle for carrying once the box is heavy with compacted trash.

14. The box of claim 1, positioned within a trash compactor on-board an aircraft.

15. A method for manufacturing a box for use in a trash compactor, comprising:

(a) providing a single-piece board construction manufactured as a multi-ply laminated material having a polyethylene coating applied to at least one side thereof;

(b) die cutting the single-piece board construction into a blank having a bottom panel separated from two side panels, two cut-away portions, two front panel flaps, and two back panel flaps via scores;

(c) forming radiating lines of weakness in the side panels;

(d) folding the blank into a box shape such that two front panel flaps overlap one another and the two back panel flaps overlap one another, and such that the cut-away portions reveal a lip panel that can be folded up over the overlap of the front and back panels;

(e) applying heat to at least a portion of the front and back panel flaps in order to cause the polyethylene coating to create a seal between the two front panel flaps and to create a seal between the two back panel flaps.

16. The method of claim 15, wherein the die cutting step further comprises forming an additional score line down a middle portion of the blank to ease collapsing of the box.

17. The method of claim 16, further comprising collapsing the box for storage in a master shipping carton.

* * * * *